US008384309B2

(12) United States Patent
Saito et al.

(10) Patent No.: US 8,384,309 B2
(45) Date of Patent: Feb. 26, 2013

(54) LIGHTING DEVICE, LIGHTING CONTROL DEVICE, AND PROJECTOR

(75) Inventors: Osamu Saito, Matsumoto (JP); Masahide Tsuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 12/869,229

(22) Filed: Aug. 26, 2010

(65) Prior Publication Data

US 2011/0062893 A1 Mar. 17, 2011

(30) Foreign Application Priority Data

Sep. 14, 2009 (JP) ..... 2009-211375

(51) Int. Cl.
*H05B 37/02* (2006.01)

(52) U.S. Cl. ..... 315/307; 315/308

(58) Field of Classification Search ..... None
See application file for complete search history.

(56) References Cited

U.S. PATENT DOCUMENTS

| | | | | |
|---|---|---|---|---|
| 5,212,428 | A * | 5/1993 | Sasaki et al. | 315/308 |
| 5,463,287 | A | 10/1995 | Kurihara et al. | |
| 5,828,177 | A * | 10/1998 | Toda et al. | 315/127 |
| 6,453,145 | B1 * | 9/2002 | Miura | 399/336 |
| 7,667,413 | B2 * | 2/2010 | Ikeda et al. | 315/293 |
| 2002/0047634 | A1 * | 4/2002 | Ito et al. | 315/291 |

* cited by examiner

*Primary Examiner* — Crystal L Hammond
(74) *Attorney, Agent, or Firm* — AdvantEdge Law Group, LLC

(57) ABSTRACT

A lighting device which supplies power to an electrode of a discharge lamp to turn on the discharge lamp, includes: a converting circuit which converts inputted direct current into alternating current; a pulse generating circuit which produces a high-voltage pulse from the alternating current received from the converting circuit and applies the high-voltage pulse to the electrode; and a trigger circuit which is disposed between the converting circuit and causes the pulse generating circuit to apply the high-voltage pulse to the electrode, wherein the trigger circuit allows the pulse generating circuit to apply the high-voltage pulse to the electrode in accordance with a drive frequency of the converting circuit.

14 Claims, 7 Drawing Sheets

LIGHTING DEVICE, LIGHTING CONTROL DEVICE, AND PROJECTOR

BACKGROUND

1. Technical Field

The present invention relates to a lighting device for turning on a discharge lamp, a lighting control device, and a projector.

2. Related Art

A projector which includes a light source, a light modulation device for modulating light emitted from the light source to form an image corresponding to image information, and a projection device for projecting the formed image is known. The light source included in this projector is often constituted by a discharge lamp such as an extra-high pressure mercury lamp containing a discharge space into which a pair of electrodes and discharge substances are sealed. In this case, a lighting control device for controlling lighting of the discharge lamp is equipped. A known type of this lighting control device includes a lighting device for supplying lamp power to the discharge lamp to turn on the discharge lamp, and a control device for controlling the operation of the lighting device (for example, see U.S. Pat. No. 5,463,287).

The lighting control device disclosed in U.S. Pat. No. 5,463,287 includes a converting circuit for controlling output current and output power, an inverter circuit for converting direct current into alternating current, an igniter circuit, a transformer which has a primary coil connected with the igniter circuit and a secondary coil connected with the inverter circuit, and a control circuit (microcomputer) for controlling the respective circuits by using a plurality of drive circuits. According to this lighting control device, the igniter circuit supplies high-voltage ignition pulses to the primary coil of the transformer in response to signals outputted from the control circuit to the drive circuits. As a result, high-voltage pulses generated on the secondary coil of the transformer are applied to the discharge lamp, and discharge is initiated from the discharge lamp.

According to the lighting control device disclosed in U.S. Pat. No. 5,463,287, however, it is possible that high voltage is applied to a control line for connecting the igniter circuit with the control circuit and the drive circuit via the control line. In this case, the control circuit may be damaged. Moreover, noise generated by the high voltage may cause malfunction of the control circuit. Thus, the control circuit needs to be resistant to high voltage and protected from noise, which complicates the structure of the lighting control circuit.

SUMMARY

It is an advantage of some aspects of the invention to provide a lighting device, a lighting control device, and a projector capable of determining timing for applying high-voltage pulses by a simplified structure.

According to a first aspect of the invention, there is provided a lighting device which supplies power to an electrode of a discharge lamp to turn on the discharge lamp and includes: a converting circuit which converts inputted direct current into alternating current; a pulse generating circuit which produces a high-voltage pulse from the alternating current received from the converting circuit and applies the high-voltage pulse to the electrode; and a trigger circuit disposed between the converting circuit and the pulse generating circuit to apply the high-voltage pulse to the electrode by the pulse generating circuit. The trigger circuit allows the pulse generating circuit to apply the high-voltage pulse to the electrode in accordance with change of a drive frequency of the converting circuit.

The discharge lamp turned on by the lighting device having this structure is a light source lamp such as an extra-high pressure mercury lamp, for example.

According to the aspect of the invention, the trigger circuit allows the pulse generating circuit to apply the high-voltage pulse to the electrode of the discharge lamp by the change of the drive frequency of the converting circuit. Thus, direct control over the pulse generating circuit is not needed for applying the high-voltage pulse. In this case, when a control device for controlling the lighting device is equipped, the control device is only required to change the drive frequency of the converting circuit. Thus, the necessity for connecting the control device and the pulse generating circuit generating high voltage by a control line or the like is eliminated. Accordingly, high voltage resistance and protection from noise are not required, and the timing for applying the high-voltage pulse can be determined by simple structure.

According to a second aspect of the invention, there is provided a lighting control device including: the lighting device described above; and a control device which controls the lighting device. The control device changes the drive frequency of the converting circuit at the time of applying the high-voltage pulse to the electrode.

According to the aspect of the invention, the control device changes the drive frequency of the converting circuit according to the time of applying the high-voltage pulse to the electrode. Thus, the high-voltage pulse can be securely applied in appropriate timing by the structure described above. Moreover, since high voltage resistance and protection from noise are not required similarly to the above aspect, the structure of the lighting control device can be simplified.

In the aspect of the invention, it is preferable that the pulse generating circuit has a switching element which allows the high-voltage pulse to be applied to the electrode while the switching element is in an ON condition, and that the trigger circuit outputs a trigger signal for bringing the switching element into the ON condition in accordance with change of a frequency of inputted current.

Examples of this switching element involve a transistor such as FET (field effect transistor) and a thyristor. In case of these types of switching element, the trigger signal is constituted by gate current, gate voltage, base current or the like.

According to this structure, the trigger circuit outputs the trigger signal for bringing the switching element of the pulse generating circuit into the ON condition in accordance with frequency change of alternating current received from the converting circuit. In this case, the switching element comes into the ON condition such that the high-voltage pulse can be applied to the electrode by the pulse generating circuit in response to the input of the trigger signal. Accordingly, the change of the drive frequency of the converting circuit can be detected based on the change of the frequency of the alternating current as an index, and the high-voltage pulse can be securely applied according to the frequency change.

According to the aspect of the invention, it is preferable that the trigger circuit includes an integrating circuit, and a signal outputting circuit connected with the integrating circuit in series to output the trigger signal when a voltage inputted via the integrating circuit exceeds a predetermined value. The control device decreases the drive frequency of the converting circuit at the time of applying the high-voltage pulse to the electrode.

According to this structure, the output voltage from the integrating circuit increases when the drive frequency of the converting circuit, i.e., the frequency of the alternating current inputted to the trigger circuit decreases. When the output voltage exceeds the predetermined value, the signal outputting circuit outputs the trigger signal to the pulse generating circuit. In this case, the switching element comes into the ON condition to apply the high-voltage pulse to the electrode at the time when the voltage inputted to the signal outputting circuit exceeds the predetermined value by the decrease in the drive frequency of the converting circuit by the control of the control device. Thus, the high-voltage pulse can be securely applied to the electrode at the time of lowering the drive frequency of the converting circuit by the control of the control device.

Alternatively, according to the aspect of the invention, it is preferable that the trigger circuit includes a resonating circuit having a predetermined resonance frequency, and a signal outputting circuit connected with the resonating circuit in series to output the trigger signal in accordance with change of a voltage inputted from the resonating circuit. The control device sets the drive frequency of the converting circuit at a frequency which produces difference between a voltage outputted from the resonating circuit at the time of applying the high-voltage pulse to the electrode and a voltage outputted from the resonating circuit at the time of not applying the high-voltage pulse to the electrode.

According to this structure, the output voltage from the resonating circuit varies when the drive frequency of the converting circuit changes. Thus, the signal outputting circuit outputs the trigger signal to the pulse generating circuit in accordance with the change of the output voltage. In this case, the switching element comes into the ON condition to apply the high-voltage pulse to the electrode by the pulse generating circuit at the time when the drive frequency of the converting circuit is changed similarly to the structure including the integrating circuit described above. Therefore, the high-voltage pulse can be applied by the pulse generating circuit. Accordingly, the high-voltage pulse can be securely applied to the electrode in desired timing.

According to the aspect of the invention, it is preferable that the control device sets the drive frequency of the converting circuit at such a frequency that the corresponding drive frequency multiplied by an odd number becomes close to the predetermined resonance frequency.

According to the aspect of the invention, it is preferable that the control device sets the drive frequency of the converting circuit at such a frequency that the drive frequency multiplied by an odd number becomes close to the predetermined resonance frequency at the time when the high-voltage pulse is applied to the electrode.

The frequency close to the resonance frequency of the resonating circuit herein refers to a frequency within a predetermined range including the resonance frequency. The predetermined range is the range containing ±10% of the resonance frequency, for example.

According to this structure, the control device sets the drive frequency of the converting circuit at such a frequency that the drive frequency multiplied by an odd number becomes close to the resonance frequency of the resonance circuit. In other words, the control device sets the drive frequency of the converting circuit at a frequency close to the resonance frequency of the resonating circuit divided by an odd number. In this case, the voltage inputted from the resonating circuit to the signal outputting circuit becomes higher than the corresponding voltage produced when the drive frequency multiplied by an even number is close to the resonance frequency of the resonating circuit. According to this structure, the difference between the voltage in case of the resonance frequency equivalent to the drive frequency multiplied by an even number and the voltage in case of the resonance frequency equivalent to the drive frequency multiplied by an odd number increases. Accordingly, the change of the voltage applied to the signal outputting circuit can be easily detected, and thus the high-voltage pulse can be securely applied to the electrode at the time of changing the drive frequency.

According to the aspect of the invention, it is preferable that the signal outputting circuit produces the trigger signal by shaping the waveform of inputted current and outputs the trigger signal to the switching element.

According to this structure, the signal outputting circuit produces the trigger signal by shaping the waveform of the inputted current. Thus, the structure of the signal outputting circuit becomes simpler than a structure which separately produces the trigger signal to be outputted to the switching element.

According to the aspect of the invention, it is preferable that the trigger circuit is provided for the converting circuit in such a condition that the trigger circuit and the pulse generating circuit are connected in parallel.

According to this structure, the trigger circuit is provided on a path different from a path along which current flows from the converting circuit to the pulse generating circuit. Thus, when the trigger circuit is in an abnormal condition, current can be kept supplied from the converting circuit to the pulse generating circuit. Accordingly, lighting of the discharge lamp can be maintained.

In case of the trigger circuit including the resonating circuit, the position to which high voltage is applied is limited to the signal outputting circuit of the trigger circuit. In this case, high voltage is not applied to the pulse generating circuit, and thus the load on the pulse generating circuit can be reduced. Moreover, the capacity of the capacitor included in the resonating circuit can be decreased.

According to a third aspect of the invention, there is provided a projector including: the lighting control device described above; and a discharge lamp which has an electrode and is turned on by the lighting control device.

According to the aspect of the invention, advantages similar to those of the lighting control device described above can be provided.

BRIEF DESCRIPTION OF THE DRAWINGS

The invention will be described with reference to the drawings, wherein like numbers reference like elements.

DESCRIPTION OF EXEMPLARY EMBODIMENTS

1. First Embodiment

A first embodiment of the invention is hereinafter described with reference to the drawings.

Figure 1:
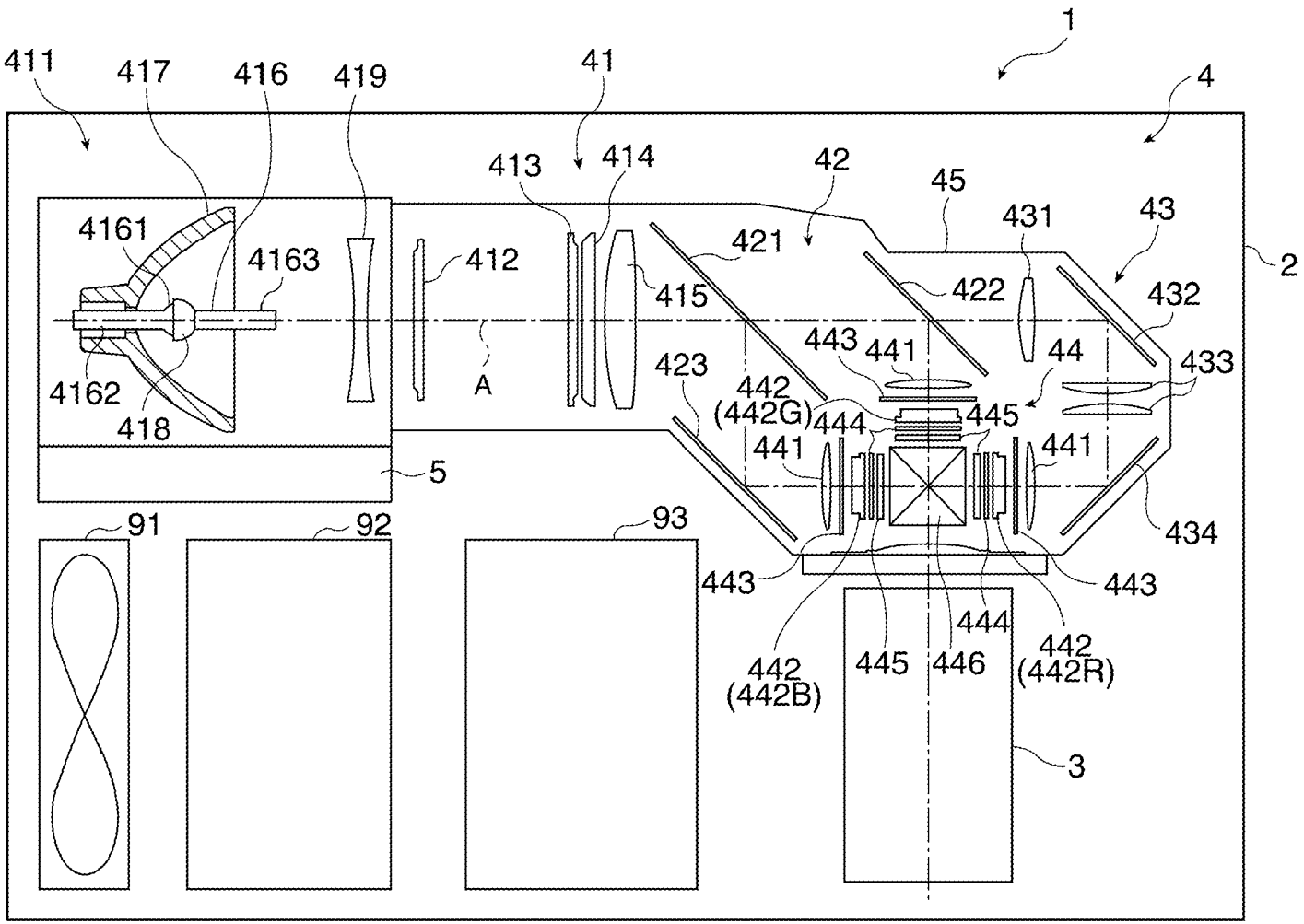
FIG. 1 schematically illustrates the structure of a projector according to a first embodiment of the invention.

FIG. 1 schematically illustrates the structure of a projector 1 according to this embodiment.

The projector 1 in this embodiment forms an image corresponding to image information by modulating light emitted from a light source unit 411 contained in the projector 1 and expands and projects the image on a projection receiving surface such as a screen. As illustrated in FIG. 1, the projector 1 includes an outer housing 2, a projection device 3, and an image forming system 4. The projector 1 further includes a cooling unit 91 having a cooling fan for cooling the interior of the projector 1 and others, a power source unit 92 for supplying power to the respective components within the projector 1, a control unit 93 for controlling the overall operation of the projector 1, and other units.

Structures of Outer Housing and Projection Device

The outer housing 2 is a housing generally having a substantially rectangular parallelepiped shape and made of synthetic resin or metal as a component for accommodating the respective devices 3 and 4, the respective units 91 through 93, and others.

The projection device 3 forms an image produced and supplied from the image forming system 4 on the projection receiving surface while expanding and projecting the corresponding image. The projection device 3 includes a not-shown combination of lenses accommodated within a cylindrical lens barrel.

Structure of Image Forming System

The image forming system 4 is an optical unit which forms image light corresponding to image information under the control of the control unit 93. The image forming system 4 includes an illumination device 41, a color separation device 42, a relay device 43, an electro-optic device 44, and an optical component housing 45 for accommodating and locating these devices 41 through 44 at predetermined positions on an illumination axis A determined inside the optical component housing 45 and for supporting the projection device 3.

The illumination device 41 has the light source unit 411, a pair of lens arrays 412 and 413, a polarization converting element 414, and a stacking lens 415.

The color separation device 42 has dichroic mirrors 421 and 422 and a reflection mirror 423. The relay device 43 has an entrance side lens 431, a relay lens 433, and reflection mirrors 432 and 434.

The electro-optic device 44 has a field lens 441, three liquid crystal panels 442 as light modulation devices (liquid crystal panel 442R for red light, liquid crystal panel 442G for green light, and liquid crystal panel 442B for blue light), three entrance side polarization plates 443, three visibility angle compensating plates 444, and three exit side polarization plates 445 for the corresponding color lights, and a cross dichroic prism 446 as a color combining unit.

According to the image forming system 4 having this structure, the illumination device 41 emits light having substantially uniform illuminance within an illumination area, and the color separation device 42 separates the light into three color lights in red (R), green (G), and blue (B). The respective separated color lights are modulated by the corresponding liquid crystal panels 442 according to image information to form images for the respective color lights. These images for respective color lights are combined by the cross dichroic prism 446, and the combined image is expanded and projected on the projection receiving surface through the projection device 3.

Structure of Light Source Unit

As illustrated in FIG. 1, the light source unit 411 includes a discharge lamp 416, a main reflection mirror 417, a sub reflection mirror 418, a collimating concave lens 419, a housing (not shown) accommodating these components 416 through 419, and a lighting control device 5 for controlling lighting of the discharge lamp 416.

The discharge lamp 416 has a substantially spherical light emission portion 4161 which contains a pair of electrodes E (E1 and E2) (see FIG. 2) and discharge substances sealed into a discharge space formed inside the discharge lamp 416, and a pair of sealing portions 4162 and 4163 extending from both ends of the light emission portion 4161 in directions away from each other. The discharge lamp 416 is constituted by an extra-high pressure mercury lamp, for example.

The main reflection mirror 417 is fixed to the sealing portion 4162 disposed on the side opposite to the side of the lens array 412 by an adhesive. The main reflection mirror 417 has a concave reflection surface on the inner surface of the main reflection mirror 417 such that light received from the light emission portion 4161 can be reflected by the reflection surface and converged at a second focus on the illumination axis A.

The sub reflection mirror 418 is a molded component made of glass and covering the area of the light emission portion 4161 on the sealing portion 4163 side (on the side opposite to the main reflection mirror 417 side). The sub reflection mirror 418 has a shape following the outer shape of the light emission portion 4161, and has a reflection surface in the area opposed to the light emission portion 4161. The sub reflection mirror 418 reflects light emitted toward the side opposite to the main reflection mirror 417 from the light emission portion 4161 such that the light can be supplied toward the reflection surface of the main reflection mirror 417 by using the reflection surface of the sub reflection mirror 418. By this method, light emitted from the light emission portion 4161 directly toward the leading end of the light source unit 411 in the light emission direction and not reaching the lens array 412 can be reduced.

The collimating concave lens 419 collimates the light reflected and converged by the main reflection mirror 417 into light traveling in parallel with the illumination axis A.

Structure of Lighting Control Device

Figure 2:
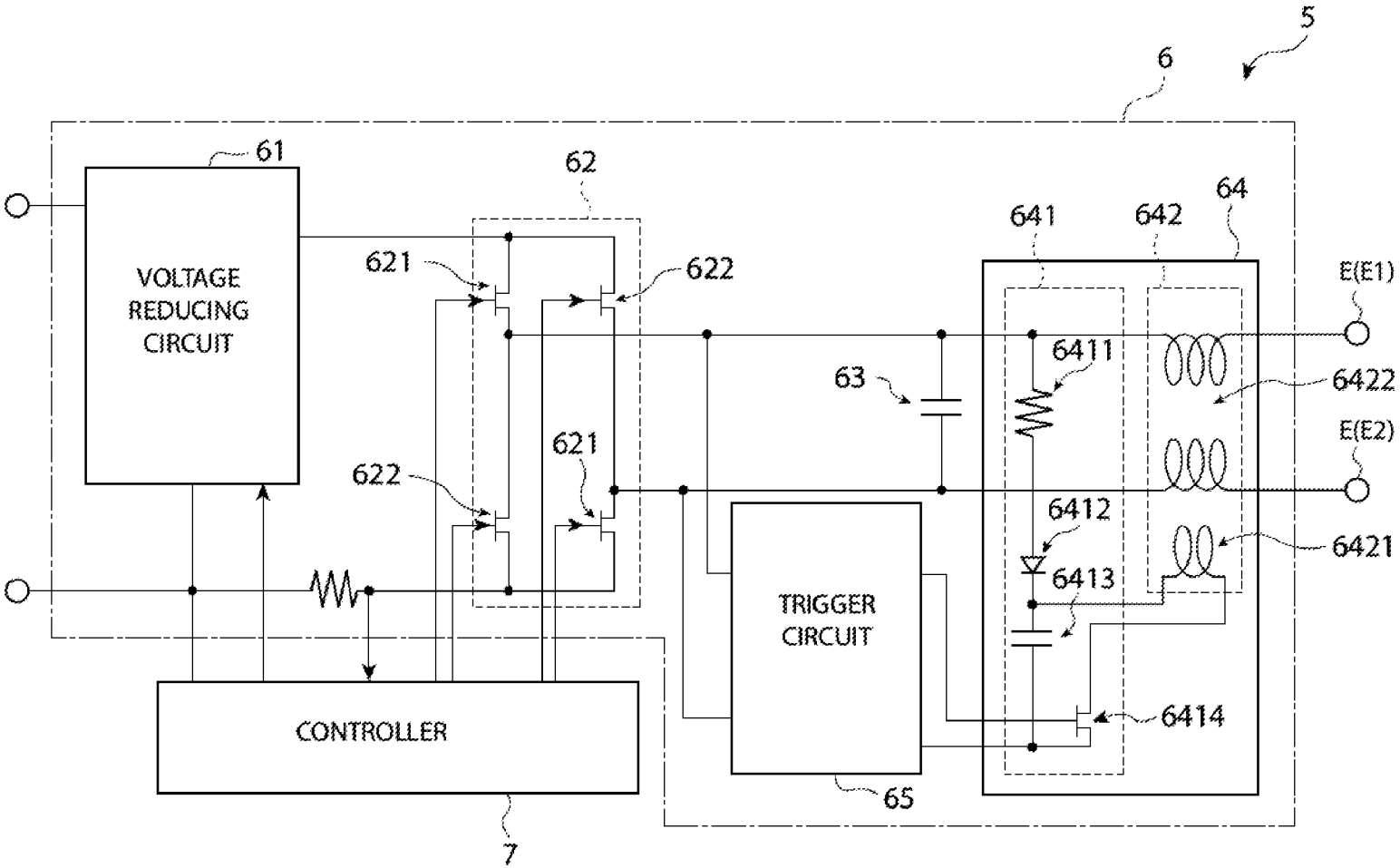
FIG. 2 illustrates the structure of a lighting control device according to the first embodiment.

FIG. 2 is a block diagram showing the structure of the lighting control device 5.

As shown in FIG. 2, the lighting control device 5 includes a lighting device 6 which converts direct current supplied from the power source unit 92 into alternating current and outputs the converted current to the electrodes E (E1 and E2) of the discharge lamp 416 to turn on the discharge lamp 416, and a controller 7 for controlling the lighting device 6 under the control of the control unit 93.

Structure of Lighting Device

The lighting device 6 includes a voltage reducing circuit 61, a converting circuit 62, a capacitor 63, a pulse generating circuit 64, and a trigger circuit 65.

The voltage reducing circuit 61 is a down-chopper circuit which reduces direct current of approximately 380V inputted from the power source unit 92 to a voltage appropriate for the discharge lamp 416 (such as a voltage in the range from about 50V to about 150V) under the control of the controller 7. Though not specifically shown in the figure, the voltage reducing circuit 61 has FETs (field effect transistors) as switching elements and coils connected in series, and diodes and capacitors branched from these elements for connection, for example. The FETs reduce inputted direct current in response to gate voltage applied by the controller 7 to a desired voltage. The coils, diodes, and capacitors perform processes for removal of high-frequency components contained in the inputted direct current, for rectification, and for conversion into constant power.

The output end of the voltage reducing circuit 61 is connected with the controller 7 described later such that the controller 7 can detect current inputted from the voltage reducing circuit 61 to the converting circuit 62 and voltage of the corresponding current.

The converting circuit 62 is an inverter circuit which converts the inputted direct current into alternating current. The converting circuit 62 is a bridge circuit having a pair of FETs 621 and a pair of FETs 622. The bridge circuit receives direct current rectified by the voltage reducing circuit 61. When the controller 7 described later applies gate voltage to the FETs 621 and FETs 622, current flows in a path containing the pair of the FETs 621 and a path containing the pair of the FETs 622 with these paths alternately short-circuited, thereby producing alternating current. The converting circuit 62 is driven at a high frequency (such as frequency of 10 kHz or higher) before lighting of the discharge lamp 416, and is driven at a low frequency (such as frequency of 1 kHz or lower) after lighting.

The capacitor 63 is a coupling capacitor for connecting the converting circuit 62 and the pulse generating circuit 64.

The pulse generating circuit 64 is an igniter circuit which operates at the start of lighting of the discharge lamp 416. More specifically, the pulse generating circuit 64 outputs high-voltage pulses to the electrodes E for dielectric breakdown between the electrodes E and initiates actuation of the discharge lamp 416. The pulse generating circuit 64 is disposed between the discharge lamp 416 and the sections of the voltage reducing circuit 61 and the converting circuit 62 in such a condition that the pulse generating circuit 64 and the discharge lamp 416 are connected in parallel. The pulse generating circuit 64 has a primary circuit 641 and an igniter transformer (hereinafter abbreviated as "transformer" in some cases) 642.

The primary circuit 641 has a resistor 6411, a diode 6412, a capacitor 6413, and an FET 6414 as a switching element. In the primary circuit 641, voltage supplied from the converting circuit 62 is rectified by the diode 6412 via the resistor 6411, and then applied to the capacitor 6413 to allow charges to be accumulated in the capacitor 6413. When gate voltage as a trigger signal is applied to the trigger circuit 65 described later with sufficient charges accumulated in the capacitor 6413, the FET 6414 is brought into ON condition (conduction condition) to release the charges accumulated in the capacitor 6413. As a result, large pulse current flows into a primary coil 6421 of the transformer 642 via the FET 6414.

The transformer 642 has the primary coil 6421 and a secondary coil 6422. The primary coil 6421 is connected with the primary circuit 641. The input end of the secondary coil 6422 is connected with the converting circuit 62, and the output end of the secondary coil 6422 is connected with the electrodes E (E1 and E2).

The transformer 642 having this structure transforms current flowing in the second coil 6422 in accordance with current flowing in the primary coil 6421. Thus, when the pulse current discussed above flows in the primary coil 6421, high-voltage pulses of approximately 10 kV are generated in the second coil 6422 and applied to the electrodes E. As a result, insulation between the electrodes E1 and E2 is broken, and the discharge lamp 416 is turned on through electric conduction between the electrodes E1 and E2 thus secured.

The discharge lamp 416 turned on in this manner operates at constant voltage load (approximately 10V to 150V). The discharge lamp 416 is controlled such that constant power can be maintained based on the output voltage and output current of the voltage reducing circuit 61 detected by the controller 7 described later.

Figure 3:
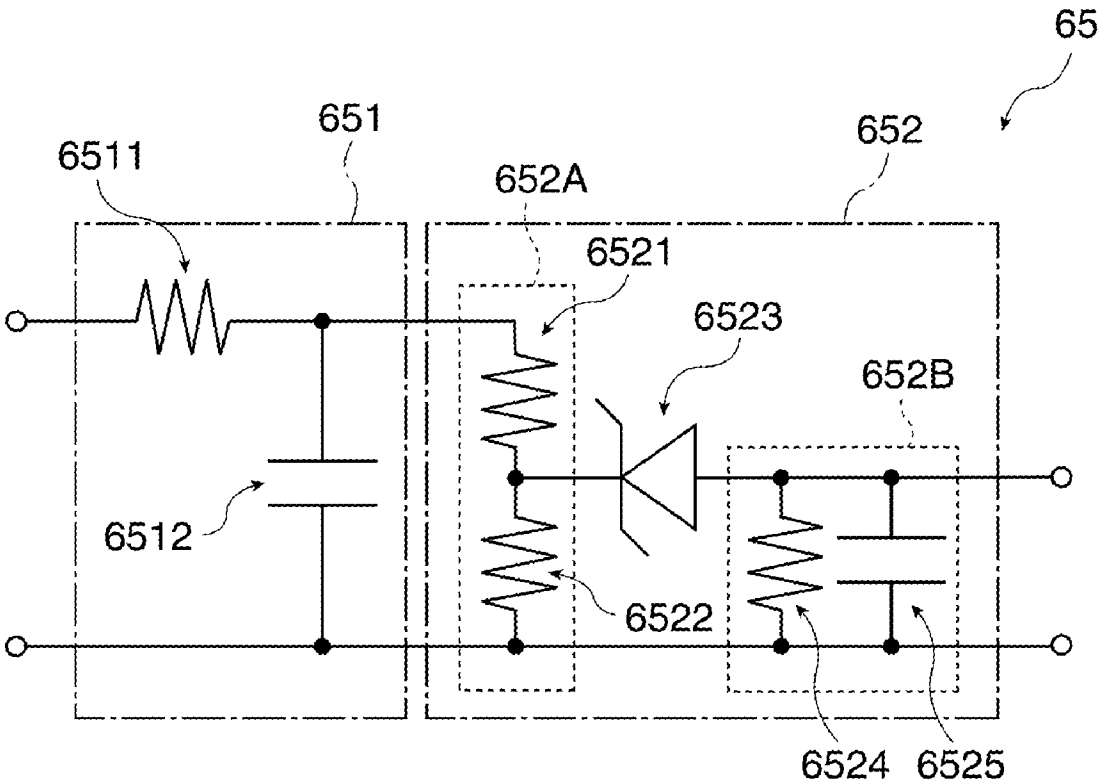
FIG. 3 is a circuit diagram showing the structure of a trigger circuit according to the first embodiment.

FIG. 3 is a circuit diagram showing the structure of the trigger circuit 65.

The trigger circuit 65 is provided for the converting circuit 62 in such a condition that the trigger circuit 65 and the pulse generating circuit 64 are connected in parallel. The trigger circuit 65 applies gate voltage to the FET 6414 as a trigger signal in accordance with frequency change (more specifically, frequency decrease) of current received from the converting circuit 62. As shown in FIG. 3, the trigger circuit 65 includes an integrating circuit 651 and a signal outputting circuit 652 connected with the integrating circuit 651 in series.

The integrating circuit 651 has a resistor 6511 and a capacitor 6512. The input end of the integrating circuit 651 is connected with the converting circuit 62, and the output end of the integrating circuit 651 is connected with the signal outputting circuit 652. The integrating circuit 651 charges and discharges the capacitor 6512. When the drive frequency of the converting circuit 62 is high (high frequency of input current), the integrating circuit 651 outputs low voltage. When the drive frequency of the converting circuit 62 is low (low frequency of input current), the integrating circuit 651 outputs high voltage.

The signal outputting circuit 652 includes a voltage dividing circuit 652A having a pair of resistors 6521 and 6522, a Zener diode 6523 provided at the output end of the voltage dividing circuit 652A, and a noise removing circuit 652B having a resistor 6524 and a capacitor 6525 connected with the Zener diode 6523.

When the voltage divided by the resistors 6521 and 6522 of the voltage dividing circuit 652A and inputted to the Zener diode 6523 exceeds Zener voltage, the signal outputting circuit 652 applies the voltage to the FET 6414 as the gate voltage via the noise removing circuit 652B.

More specifically, when the voltage inputted to the Zener diode 6523 from the integrating circuit 651 via the voltage dividing circuit 652A becomes high and exceeds Zener voltage (rated breakdown voltage) as a result of decrease in the frequency of the current inputted to the trigger circuit 65, the signal outputting circuit 652 applies the corresponding voltage to the FET 6414 as gate voltage. As a result, the primary circuit 641 operates and produces high-voltage pulses in the second coil 6422, and supplies the high-voltage pulses to the electrodes E.

Figures 4A, 4B, 4C:
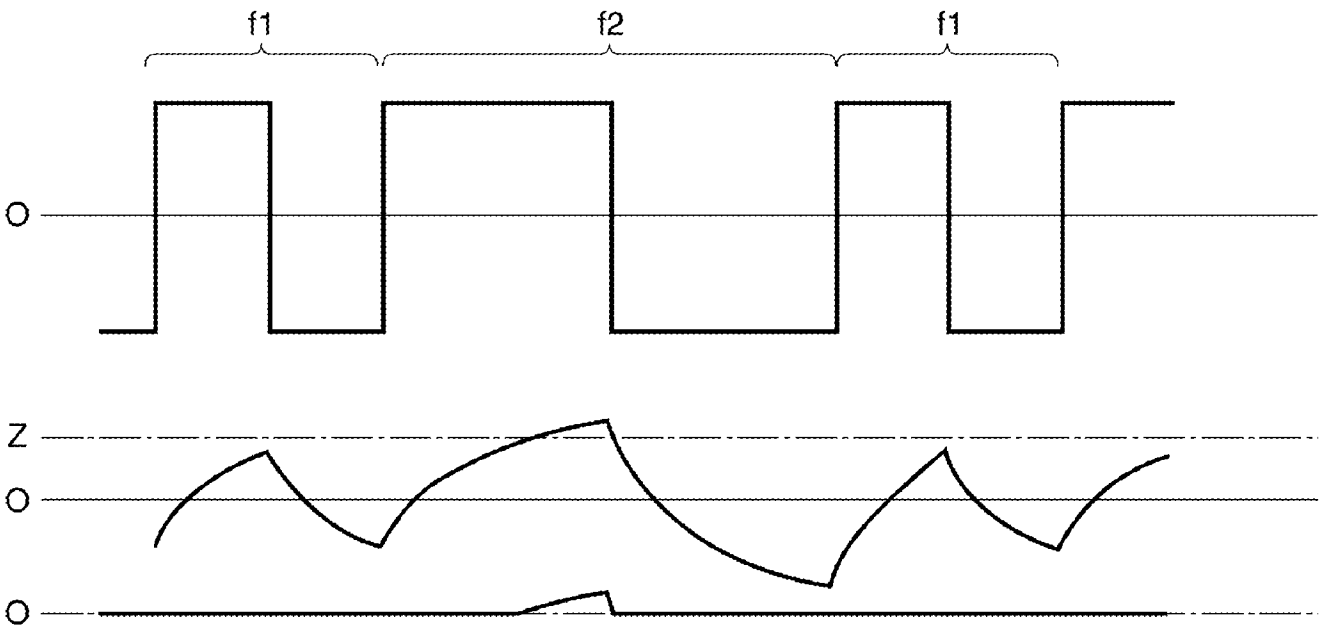
FIGS. 4A through 4C are graphs showing voltage waveforms inputted to and outputted from the trigger circuit according to the first embodiment.

FIGS. 4A through 4C are graphs showing voltage waveforms inputted to and outputted from the trigger circuit 65. More specifically, FIG. 4A is a graph showing a voltage waveform applied to the integrating circuit 651, FIG. 4B is a graph showing a voltage waveform applied to the Zener diode 6523, and FIG. 4C is a graph showing a voltage waveform outputted from the signal outputting circuit 652.

More specifically, when the voltage having the waveform shown in FIG. 4A is applied to the trigger circuit 65, the voltage waveform outputted from the integrating circuit 651 becomes the waveform shown in FIG. 4B. When the frequency of the alternating current inputted to the integrating circuit 651 changes from a frequency f1 to a frequency f2 (decreases) by the control of the controller 7, the output voltage from the integrating circuit 651 increases as shown in FIG. 4B. Thus, the voltage applied to the Zener diode 6523 increases. When this voltage exceeds a Zener voltage Z, current flows in the Zener diode 6523 in the opposite direction. Then, the voltage exceeding the Zener diode is applied to the gate of the FET 6414 as shown in FIG. 4C. As a result, the FET 6414 comes into the ON condition.

The respective constants of the resistor 6511 and the capacitor 6512, the Zener voltage, and the drive frequency of the converting circuit 62 are set at values at which the voltage applied to the Zener diode 6523 does not exceed the Zener voltage Z when the frequency of the alternating current outputted from the converting circuit 62 is the frequency f1, and at which the voltage applied to the Zener diode 6523 exceeds the Zener voltage Z and produces voltage sufficient for bringing the FET 6414 into ON condition to operate the primary circuit 641 when the frequency of the corresponding alternating current is the frequency f2.

Structure of Controller

The controller 7 controls the operation of the lighting device 6 under the control of the control unit 93 based on the output voltage and output current from the voltage reducing circuit 61. For example, as described above, the controller 7 connected with the voltage reducing circuit 61 applies the gate voltage to the FET of the voltage reducing circuit 61 to reduce current supplied from the voltage reducing circuit 61 to the converting circuit 62.

In addition, the controller 7 connected with the respective FETs 621 and 622 included in the converting circuit 62 outputs the gate voltage to the FETs 621 and 622 to allow the converting circuit 62 to generate alternating current from direct current. In this case, the controller 7 produces alternating current having the frequencies described above by changing the drive frequency of the converting circuit 62, and applies the gate voltage to the FET 6414 of the primary circuit 641 by using the trigger circuit 65 as explained above. The change of the drive frequency of the converting circuit 62 under the control of the controller 7 is carried out after sufficient charges are accumulated in the capacitor 6413 of the primary circuit 641. In this embodiment, the controller 7 determines the time when the sufficient charges are accumulated based on the elapsed time from the operation start of the lighting device 6.

According to the projector 1 in this embodiment, the following advantages are offered.

(1) The trigger circuit 65 allows the pulse generating circuit 64 to apply high-voltage pulses to the electrodes E according to the change of the drive frequency of the converting circuit 62, that is, the change of the frequency of the alternating current outputted from the converting circuit 62. In this case, the controller 7 is not required to perform direct control over the pulse generating circuit 64 while the high-voltage pulses are being applied. Thus, the necessity for connecting the controller 7 and the pulse generating circuit 64 generating high voltage by a control line or the like is eliminated, and the controller 7 not receiving high voltage is not required to be resistant to high voltage and protected from noise. Accordingly, the structure of the lighting control device 5 can be simplified, and high-voltage pulses can be applied to the electrodes in arbitrary timing.

(2) The controller 7 changes the drive frequency of the converting circuit 62 at the time of applying the high-voltage pulses. Thus, the high-voltage pulses can be securely applied at that timing.

(3) The trigger circuit 65 applies the gate voltage (trigger signal) for bringing the FET 6414 into ON condition in accordance with the frequency change of the alternating current inputted from the converting circuit 62. Accordingly, the change of the drive frequency of the converting circuit 62 can be detected based on the change of the frequency of the inputted alternating current as an index, and thus the high-voltage pulses can be securely applied according to the frequency change.

(4) When the drive frequency of the converting circuit 62, i.e., the frequency of the inputted alternating current decreases, the output voltage from the integrating circuit 651 increases. When the output voltage exceeds the Zener voltage Z, the signal outputting circuit 652 applies the gate voltage to the FET 6414. In this case, the FET 6414 is brought into ON condition to apply the high-voltage pulses to the electrode E at the time when the drive frequency of the converting circuit 62 is lowered by the controller 7. Thus, the high-voltage pulses can be securely applied to the electrodes E in arbitrary timing.

(5) The signal outputting circuit 652 produces the gate voltage as the trigger signal by shaping the waveform of the inputted current. Thus, the structure of the signal outputting circuit 652 becomes simpler than a structure which separately produces the gate voltage.

(6) The trigger circuit 65 is provided for the converting circuit 62 in such a condition that the trigger circuit 65 and the pulse generating circuit 64 are connected in parallel. Thus, when the trigger circuit 65 is in an abnormal condition, current can be kept supplied from the converting circuit 62 to the pulse generating circuit 64. Accordingly, lighting of the discharge lamp 416 can be maintained.

2. Second Embodiment

A second embodiment according to the invention is now described.

The projector in this embodiment has structure similar to that of the projector 1 described above except that a resonating circuit 661 is provided in place of the integrating circuit 651. In the following description, the same reference numbers are given to parts same or substantially same as those described above, and the same explanation is not repeated.

Figure 5:
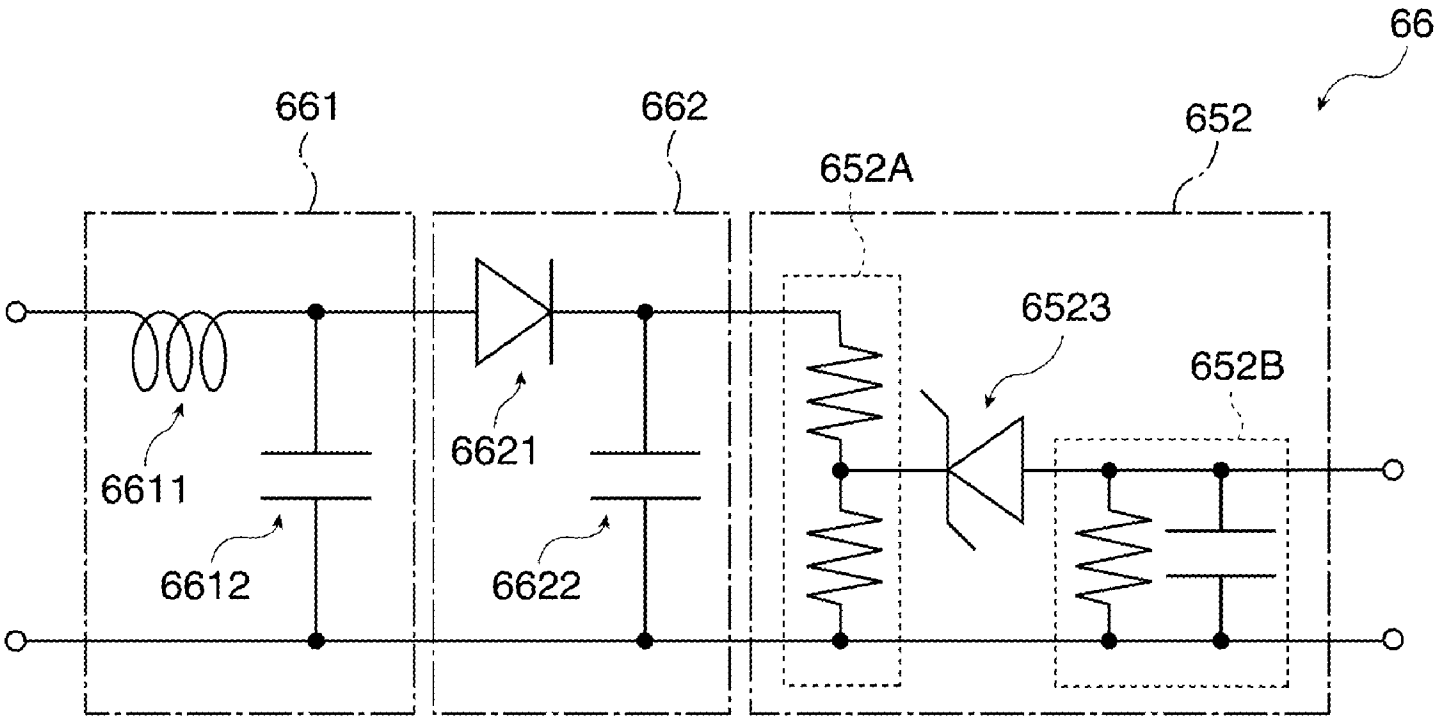
FIG. 5 is a circuit diagram showing the structure of a trigger circuit of a projector according to a second embodiment of the invention.

FIG. 5 is a circuit diagram showing the structure of a trigger circuit 66 included in the projector according to this embodiment.

The projector in this embodiment has structure similar to that of the projector 1 described above except that the trigger circuit 66 is provided in place of the trigger circuit 65.

As shown in FIG. 5, the trigger circuit 66 has the resonating circuit 661, a rectifying circuit 662, and the signal outputting circuit 652, and is provided for the converting circuit 62 in such a condition that the trigger circuit 66 and the pulse generating circuit 64 are connected in parallel similarly to the trigger circuit 65.

The resonating circuit 661 has a coil 6611 and a capacitor 6612, and generates free oscillation of inputted current. A predetermined resonance frequency is determined for the resonating circuit 661. For bringing the FET 6414 into ON condition (applying gate voltage) to apply high-voltage pulses to the electrodes E, the controller 7 sets the drive frequency of the converting circuit 62 (frequency of produced alternating current) multiplied by an odd number becomes close to the predetermined resonance frequency.

The rectifying circuit 662 has a diode 6621 and a capacitor 6622, and connects with the resonating circuit 661 in series. The rectifying circuit 662 rectifies current outputted from the resonating circuit 661 and outputs the rectified current to the signal outputting circuit 652.

The signal outputting circuit 652 connects with the rectifying circuit 662 in series, and has the voltage dividing circuit 652A, the Zener diode 6523, and the noise removing circuit 652B as described above.

Figure 6:
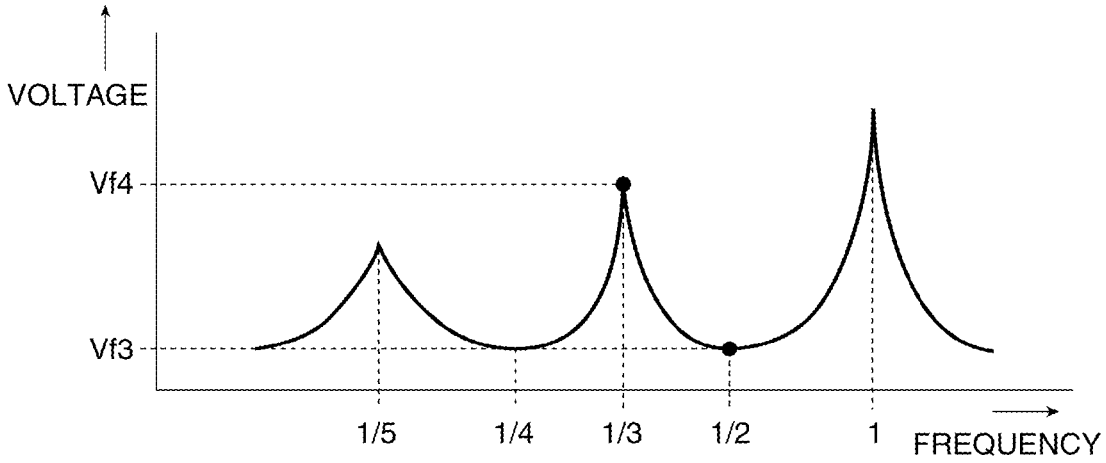
FIG. 6 shows the relationship between a proportion of a frequency of alternating current to a resonance frequency and voltage outputted via a resonating circuit according to the second embodiment.

FIG. 6 shows the relationship between a proportion of the frequency of the alternating current to the resonance frequency of the resonating circuit 661 and the voltage outputted from the resonating circuit 661.

The trigger circuit 66 inputs the alternating current received from the converting circuit 62 to the signal outputting circuit 652 via the resonating circuit 661 and the rectifying circuit 662. In this case, the voltage outputted from the resonating circuit 661 by resonance becomes higher when the frequency of the alternating current multiplied by an odd number is close to the resonance frequency of the resonating circuit 661 than when the frequency of the alternating current multiplied by an even number is close to the resonance frequency. In other words, the voltage outputted from the resonating circuit 661 by resonance becomes higher when the frequency of the alternating current is determined at a frequency close to the resonance frequency divided by an odd number (such as points 1, ⅓, and ⅕ in FIG. 6) than when the frequency of the alternating current is determined at a frequency close to the resonance frequency divided by an even number (such as points ½ and ¼ in FIG. 6).

When the voltage applied to the Zener diode 6523 via the voltage dividing circuit 652A exceeds the Zener voltage Z, current flows in the Zener diode 6523 in the opposite direction. As a result, the gate voltage (trigger signal) is applied to the FET 6414 via the noise removing circuit 652B, and the FET 6414 is brought into ON condition to actuate the primary circuit 641.

Figure 7A:
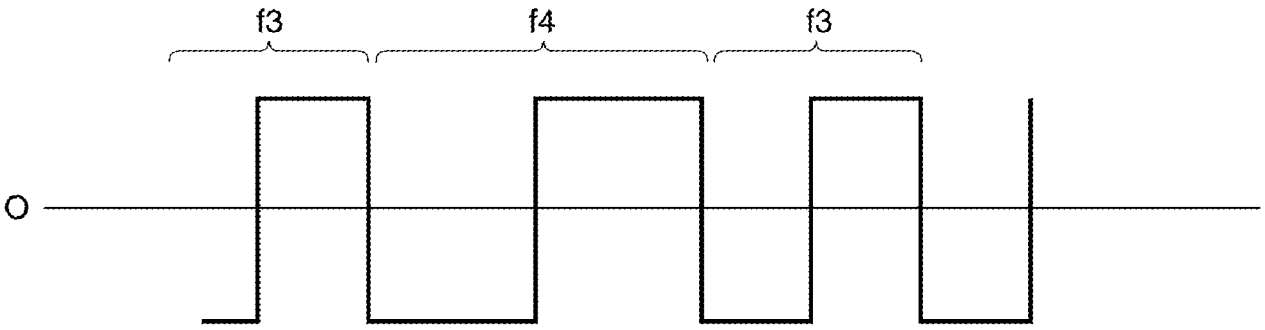
FIGS. 7A and 7B are graphs showing voltage waveforms applied to the trigger circuit according to the second embodiment.
Figure 7B:
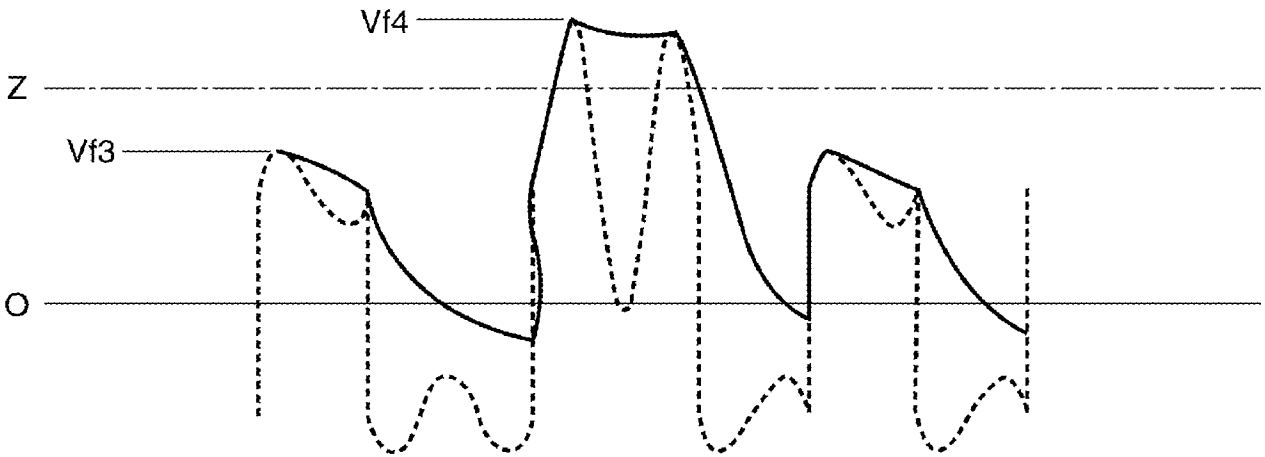

FIGS. 7A and 7B are graphs showing voltage waveforms applied to the trigger circuit 66. More specifically, FIG. 7A is a graph showing a voltage waveform applied to the resonating circuit 661, and FIG. 7B is a graph showing a voltage waveform applied to the Zener diode 6523.

For example, when the controller 7 sets the drive frequency of the converting circuit 62 (frequency of inputted alternating current) at a frequency f3 close to ½ of the resonance frequency of the resonating circuit 661 as shown in FIG. 7A, the voltage applied to the Zener diode 6523 becomes a voltage Vf3 shown in FIG. 7B. In this case, the voltage does not exceed the Zener voltage Z. Thus, the gate voltage is not applied to the FET 6414 via the Zener diode 6523, and the primary circuit 641 does not start.

On the other hand, when the controller 7 sets the drive frequency of the converting circuit 62 at a frequency f4 close to ⅓ of the resonance frequency of the resonating circuit 661, the voltage applied to the Zener diode 6523 becomes a voltage Vf4 higher than the voltage Vf3 by the resonance of the resonating circuit 661 as shown in FIG. 7B. In this case, the voltage exceeds the Zener voltage Z. Thus, the gate voltage is applied to the FET 6414 via the Zener diode 6523 to start the primary circuit 641 and further the pulse generating circuit 64.

The constants of the coil 6611 and the capacitors 6612 and 6622 of the trigger circuit 66, the voltage dividing circuit 652A, the Zener voltage Z, and the drive frequency of the converting circuit 62 are determined at values at which a voltage exceeding the Zener voltage Z is not applied to the Zener diode 6523 when the frequency of the output current from the converting circuit 62 is set at the frequency f3 and is applied to the Zener diode 6523 to generate the gate voltage for bringing the FET 6414 into ON condition when the frequency of the output current from the converting circuit 62 is set at the frequency f4.

According to the projector in this embodiment, the following advantages are provided as well as the advantages (1) through (3) and (5) and (6) of the projector 1.

(7) When the frequency of the inputted alternating current changes (lowers) by the change (lowering) of the drive frequency of the converting circuit 62 by the control of the controller 7, the output voltage from the resonating circuit 661 changes (increases). Based on this change of the output voltage, the signal outputting circuit 652 applies the gate voltage to the FET 6414 as the trigger signal. According to this structure, the FET 6414 is brought into ON condition and thus the high-voltage pulses can be applied to the electrodes E by using the pulse generating circuit 64 at the time when the drive frequency of the converting circuit 62 is changed similarly to the structure including the integrating circuit 651 described above. Accordingly, the high-voltage pulses can be securely applied to the electrodes E in appropriate timing.

(8) The controller 7 sets the drive frequency of the converting circuit 62 at such a value that the drive frequency multiplied by an odd number becomes close to the resonance frequency of the resonating circuit 661. In other words, the controller 7 sets the drive frequency of the converting circuit 62 at a frequency close to the resonance frequency of the resonating circuit 661 divided by an odd number. In this case, the voltage inputted from the resonating circuit 661 to the signal outputting circuit 652 becomes higher than the corresponding voltage produced when the drive frequency multiplied by an even number is close to the resonance frequency of the resonating circuit 661. According to this structure, the change of the voltage applied to the signal outputting circuit 652 can be easily detected, and thus the timing for changing the drive frequency, that is, the timing for applying the high-voltage pulses can be easily detected. Accordingly, the gate voltage can be securely applied at the time of changing the drive frequency, and thus the high-voltage pulses can be securely and appropriately applied to the electrodes E.

(9) The trigger circuit 66 is provided for the converting circuit 62 in such a condition that the trigger circuit 66 and the pulse generating circuit 64 are connected in parallel. Thus, the position at which high voltage is generated by resonance of the resonating circuit 661 is limited to the trigger circuit 66. In this case, high voltage is not applied to the pulse generating circuit 64, and thus the load on the pulse generating circuit 64 can be reduced. Moreover, since only change of voltage detectable by the signal outputting circuit 652 (only voltage sufficient for exceeding the Zener voltage Z) is required to be produced by the resonating circuit 661, the capacity of the capacitor 6612 included in the resonating circuit 661 can be reduced.

3. Modification of Embodiments

The invention is not limited to the embodiments described herein but includes modifications, improvements and the like within the scope of the invention.

The trigger circuit 65 in the first embodiment has the integrating circuit 651 and the signal outputting circuit 652. The trigger 66 in the second embodiment has the resonating circuit 661, the rectifying circuit 662, and the signal outputting circuit 652. However, the circuit structure may be constructed otherwise as long as it can detect the change of the drive frequency of the converting circuit 62 and output a trigger signal for allowing the pulse generating circuit 64 to apply high-voltage pulses to the electrodes E in accordance with the change.

According to the respective embodiments, the pulse generating circuit 64 has the FET 6414 as the switching element. However, the pulse generating circuit 64 may have other structure as long as high-voltage pulses can be applied to the electrodes E according to an inputted trigger signal and a predetermined signal input. Also, other switching elements such as other transistors and thyristors may be employed. In this case, the structure of the trigger circuit may be varied in correspondence with the types of switching element.

According to the first embodiment, the controller 7 switches the drive frequency of the converting circuit 62 from a high frequency to a low frequency at the time of applying the high-voltage pulses. However, the controller 7 may change the corresponding drive frequency from a low frequency to a high frequency, for example. In this case, the trigger circuit is only required to detect the change of the frequency of inputted alternating current and output a trigger signal to the pulse generating circuit.

According to the second embodiment, the drive frequency of the converting circuit 62 (i.e., frequency of alternating current) is set at ½ of the resonance frequency of the resonating circuit 661 before the gate voltage as the trigger signal is applied to the FET 6414, and the drive frequency of the converting circuit 62 is set at ⅓ of the resonance frequency while the gate voltage is being applied. However, other structure may be employed as long as a detectable potential difference can be produced between the period before applying the gate voltage and the period of applying the gate voltage. For example, the drive frequency of the converting circuit may be set at ¼ of the resonance frequency before applying the gate voltage and at ⅓ of the resonance frequency while applying the gate voltage. In addition, the drive frequency is not limited to a frequency equivalent to the precise resonance frequency divided by an even number or a frequency equivalent to the precise resonance frequency divided by an odd number but may be a frequency close to these frequencies as long as a detectable potential difference can be produced. Moreover, the drive frequency of the converting circuit 62 set at a frequency equivalent to the resonance frequency divided by an even number may be changed to a frequency equivalent to the resonance frequency divided by an odd number at the time of applying the gate voltage.

According to the respective embodiments, the signal outputting circuit 652 applies the gate voltage to the FET 6414 by using current flowing in the Zener diode 6523 in the opposite direction. However, a trigger signal produced based on the detection in excess of the Zener voltage Z for providing the conduction condition (ON condition) of the switching element of the pulse generating circuit may be outputted, for example.

According to the respective embodiments, the trigger circuits 65 and 66 are provided for the converting circuit 62 in such a condition that any of the trigger circuits 65 and 66 and the pulse generating circuit 64 are connected in parallel. However, it is only required that each of the trigger circuits 65 and 66 is disposed between the converting circuit 62 and the pulse generating circuit 64. For example, the converting circuit, the trigger circuit, and the pulse generating circuit may be connected in series.

According to the respective embodiments, the projector 1 including the three liquid crystal panels 442R, 442G, and 442B has been discussed. However, the invention is applicable to a projector including two or a smaller number of or four or a larger number of liquid crystal panels.

While the image forming system 4 has a substantially L shape in the plan view in the respective embodiments, the image forming system 4 may have a substantially U shape in the plan view.

While the liquid crystal panels 442 each of which has a surface for receiving light and a surface for releasing light as different surfaces are used in the respective embodiments, reflection-type liquid crystal panels each of which has the same surface for receiving light and releasing light may be employed.

According to the respective embodiments, the projector 1 includes the liquid crystal panels 442 as the light modulation devices. However, light modulation devices having other structure may be used as long as they can modulate entering light according to image information and form optical images. For example, the invention is applicable to a projector which has devices containing micromirros other than liquid crystals. In case of the light modulation devices of this type, the entrance side and exit side polarization plates 443 and 445 can be eliminated.

According to the respective embodiments, the lighting control device 5 for controlling the lighting of the discharge lamp 416 is included in the projector 1. However, the lighting control device 5 may be incorporated in an illumination device such as a desk lamp. In addition, the lighting device 6 contained in the lighting control device 5 may be used separately and independently.

Accordingly, the technology of the invention is applicable to a lighting device of a discharge lamp, and particularly appropriately used for a lighting control device included in a projector.

The entire disclosure of Japanese Patent Application No. 2009-211375, filed Sep. 14, 2009 is expressly incorporated by reference herein.

What is claimed is:

1. A lighting device which supplies power to an electrode of a discharge lamp to turn on the discharge lamp, comprising:

a converting circuit which converts inputted direct current into alternating current;

a pulse generating circuit which produces a high-voltage pulse from the alternating current received from the converting circuit and applies the high-voltage pulse to the electrode; and a trigger circuit which is disposed between the converting circuit and the pulse generating circuit and causes the pulse generating circuit to apply the high-voltage pulse to the electrode, wherein the trigger circuit allows the pulse generating circuit to apply the high-voltage pulse to the electrode in accordance with a drive frequency of the converting circuit.

2. A lighting control device, comprising:

the lighting device according to claim 1; and a control device which controls the lighting device, wherein the control device changes the drive frequency of the converting circuit at the time of applying the high-voltage pulse to the electrode.

3. The lighting control device according to claim 2, wherein:

the pulse generating circuit has a switching element which allows the high-voltage pulse to be applied to the electrode while the switching element is in an ON condition; and the trigger circuit outputs a trigger signal for bringing the switching element into the ON condition in accordance with a frequency of inputted current.

4. The lighting control device according to claim 3, wherein:

the trigger circuit includes an integrating circuit, and a signal outputting circuit connected with the integrating circuit in series to output the trigger signal when a voltage inputted via the integrating circuit exceeds a predetermined value; and the control device decreases the drive frequency of the converting circuit at the time of applying the high-voltage pulse to the electrode.

5. The lighting control device according to claim 4, wherein the signal outputting circuit produces the trigger signal by shaping the waveform of inputted current and outputs the trigger signal to the switching element.

6. The lighting control device according to claim 4, wherein the decrease in the drive frequency of the converting circuit results in an increase in the voltage inputted to the signal outputting circuit via the integrating circuit.

7. The lighting control device according to claim 4, wherein:

the signal outputting circuit includes a voltage dividing circuit and a Zener diode, and the trigger circuit outputs the trigger signal only when a voltage inputted to the Zener diode from the integrating circuit, via the voltage dividing circuit, exceeds a Zener voltage of the Zener diode.

8. The lighting control device according to claim 3, wherein:

the trigger circuit includes a resonating circuit having a predetermined resonance frequency, and a signal outputting circuit connected with the resonating circuit to output the trigger signal in accordance with a voltage inputted from the resonating circuit; and the control device sets the drive frequency of the converting circuit at a frequency which produces difference between a voltage outputted from the resonating circuit at the time of applying the high-voltage pulse to the electrode and a voltage outputted from the resonating circuit at the time of not applying the high-voltage pulse to the electrode.

9. The lighting control device according to claim 8, wherein the control device sets the drive frequency of the converting circuit at such a frequency that the corresponding drive frequency multiplied by an odd number becomes close to the predetermined resonance frequency at the time of applying the high-voltage pulse to the electrode.

10. The lighting control device according to claim 3, wherein the switching element comprises a transistor, and the trigger signal output by the trigger circuit is a gate voltage applied to a gate of the transistor.

11. The lighting control device according to claim 2, wherein the trigger circuit is provided for the converting circuit in such a condition that the trigger circuit and the pulse generating circuit are connected in parallel.

12. A projector comprising:

the lighting control device according to claim 2; and a discharge lamp which has an electrode and is turned on by the lighting control device.

13. The lighting device according to claim 1, wherein the trigger circuit allows the pulse generating circuit to apply the high-voltage pulse to the electrode in accordance with a change in the drive frequency of the converting circuit.

14. The lighting device according to claim 1, wherein:

the converting circuit converts the inputted direct current into alternating current having a first frequency and a second frequency, the first frequency being higher than the second frequency, and the trigger circuit allows the pulse generating circuit to apply the high-voltage pulse to the electrode when the frequency of the alternating current is the second frequency.

* * * * *